US009874423B1

(12) United States Patent
Hughes

(10) Patent No.: US 9,874,423 B1
(45) Date of Patent: Jan. 23, 2018

(54) MEDICAL KIT CARRIER FOR BODY ARMOR VESTS

(71) Applicant: Gary D. Hughes, Heber, UT (US)

(72) Inventor: Gary D. Hughes, Heber, UT (US)

(73) Assignee: SURVIVIAL ARMOR, INC., Fort Myers, FL (US)

( * ) Notice: Subject to any disclaimer, the term of this patent is extended or adjusted under 35 U.S.C. 154(b) by 0 days.

(21) Appl. No.: 14/627,438

(22) Filed: Feb. 20, 2015

Related U.S. Application Data

(60) Provisional application No. 62/042,954, filed on Aug. 14, 2014.

(51) Int. Cl.

| | |
|---|---|
| ***F41H 1/02*** | (2006.01) |
| ***A41D 1/04*** | (2006.01) |
| ***A41D 27/20*** | (2006.01) |
| ***A41D 13/00*** | (2006.01) |

(52) U.S. Cl.
CPC ..... *F41H 1/02* (2013.01); *A41D 1/04* (2013.01); *A41D 13/0012* (2013.01); *A41D 27/20* (2013.01)

(58) Field of Classification Search
CPC ..... A41D 27/20; A41D 13/0012; A41D 1/04; A41D 13/0518; A41D 27/201; A41D 27/205; A41D 27/207
USPC ..... 2/102, 49.5, 247, 249, 250, 251, 252, 2/254, 463, 2.5
See application file for complete search history.

(56) References Cited

U.S. PATENT DOCUMENTS

| | | | | |
|---|---|---|---|---|
| 3,634,889 | A | 1/1972 | Rolsten | |
| 5,054,127 | A * | 10/1991 | Zevchak | 2/247 |
| 5,465,425 | A * | 11/1995 | Crispin | 2/102 |
| 5,644,792 | A | 7/1997 | Tishler | |
| 6,098,196 | A * | 8/2000 | Logan | 2/2.5 |
| 6,397,398 | B1 * | 6/2002 | Herder | 2/249 |
| 7,712,645 | B2 | 5/2010 | Calkin | |
| 8,032,951 | B1 * | 10/2011 | Nestberg et al. | 2/247 |
| 2005/0120464 | A1 * | 6/2005 | Clark | 2/247 |
| 2005/0246823 | A1 * | 11/2005 | Groom | 2/247 |
| 2009/0282595 | A1 * | 11/2009 | Branson et al. | 2/2.5 |
| 2010/0083422 | A1 * | 4/2010 | Lebl | 2/251 |
| 2011/0099682 | A1 * | 5/2011 | Earley | 2/115 |
| 2012/0167288 | A1 * | 7/2012 | Chen et al. | 2/458 |
| 2013/0081195 | A1 * | 4/2013 | Faridoon | 2/102 |
| 2014/0101810 | A1 | 4/2014 | Tirard | |
| 2014/0283283 | A1 * | 9/2014 | Chumbler | 2/253 |

FOREIGN PATENT DOCUMENTS

| | | |
|---|---|---|
| DE | 102013000224 | 12/2013 |
| WO | WO2011/022641 | 2/2011 |

* cited by examiner

*Primary Examiner* — Richale Quinn
(74) *Attorney, Agent, or Firm* — Edward M. Livingston, Esq.; Bryan L. Loeffler, Esq.; Livingston Loeffler, P.A.

(57) ABSTRACT

A medical kit carrier (1) that is integrated or attachable to a body armor vest (9). Straps (15) of the body armor vest may be attached to hook and loop fastener (12) located on a front surface (13) of the medical kit carrier. A pouch (16) located in the medical kit carrier used for storing supplies, such as medical supplies, may be easily removed from the medical kit carrier using a pull strap (17) that is looped around a bottom edge (18) of the pouch. When a tab (19) on the pull strap is pulled, the pull strap lifts the pouch out of the medical kit carrier.

8 Claims, 2 Drawing Sheets

MEDICAL KIT CARRIER FOR BODY ARMOR VESTS

CROSS-REFERENCE TO RELATED APPLICATION

This application claims priority to provisional patent application No. 62/042,954 filed on Aug. 28, 2014, which is currently pending. The patent application identified above is incorporated herein by reference in its entirety to provide continuity of disclosure.

FIELD OF THE INVENTION

This invention relates to body armor vests, and more particularly to a carrier for a body armor vest that holds a medical kit and provides quick access to the medical kit in emergency situations.

BACKGROUND OF THE INVENTION

Soldiers, police and other military and paramilitary personnel normally carry medical first aid kits in the event of injury. These medical kits are commonly carried in backpacks or in pockets of clothing where the medical kits are not quickly assessable and/or the location is not known to others. This creates a serious problem in medical emergencies where life threatening injuries need to be treated and time is of the essence.

Therefore, a need exists for a medical kit carrier for a body armor vest that holds a medical kit and provides quick access to the medical kit in emergency situations.

The relevant prior art includes the following references:

| Pat. No. | Inventor | Issue/Publication Date |
|---|---|---|
| (U.S. Patent References) | | |
| 3,634,889 | Rolsten | Jan. 18, 1972 |
| 5,054,127 | Zevchak | Oct. 8, 1991 |
| 5,644,792 | Tishler | Jul. 8, 1997 |
| 6,098,196 | Logan | Aug. 8, 2000 |
| 7,712,645 | Calkin | May 11, 2010 |
| 2014/0101810 | Tirard | Apr. 17, 2014 |
| (Foreign Patent References) | | |
| WO2011/022641 | Carter | Feb. 24, 2011 |
| DE 102013000224 | Hoschele et al. | Dec. 19, 2013 |

SUMMARY OF THE INVENTION

The primary object of the present invention is to provide a medical kit carrier for body armor vests that holds a medical kit and provides quick access to the medical kit in emergency situations.

An additional object of the present invention is to provide a medical kit carrier that is worn in a location on a body armor vest that is easily accessible by the wearer or by another individual from the wearer's body.

An additional object of the present invention is to provide medical kit carrier that does not interfere with the function of the body armor vest on which the carrier is attached.

The present invention fulfills the above and other objects by providing a medical kit carrier having a preferably rectangular shape with a front panel secured to a rear panel along a lower edge and side edges, thereby creating an opening along the upper edge for accessing the interior of the carrier.

A front surface and a rear surface of the medical kit carrier each have a fastening device, such as a hook and loop fastener, located thereon. The fastening means allows the medical kit carrier to be attached to a body armor vest. Alternatively, the medical kit carrier may be integrated into a body armor vest as a pocket located on an outer surface of the vest. A hook and loop fastener located on the rear surface of the medical kit carrier is attached to the hook and loop fastener located on the front of the vest to which vest securing side straps are normally attached. However, the medical kit carrier does not interfere with the attachment points on the vest because the side straps may be attached to the hook and loop fastener located on the front surface of the medical kit carrier. A pouch located in the medical kit carrier used for storing supplies, such as medical supplies, may then be easily removed from the medical kit carrier using a pull strap that is looped around a bottom edge of the pouch. When a tab on the pull strap is pulled, the pull strap lifts the pouch out of the medical kit carrier. Closures may also be located on the opening of the medical kit carrier to seal shut the medical kit carrier.

The contents carried in the medical kit carrier of the present invention may be any object or supplies needed by the individual wearing the body armor vest on which the medical kit carrier is located.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
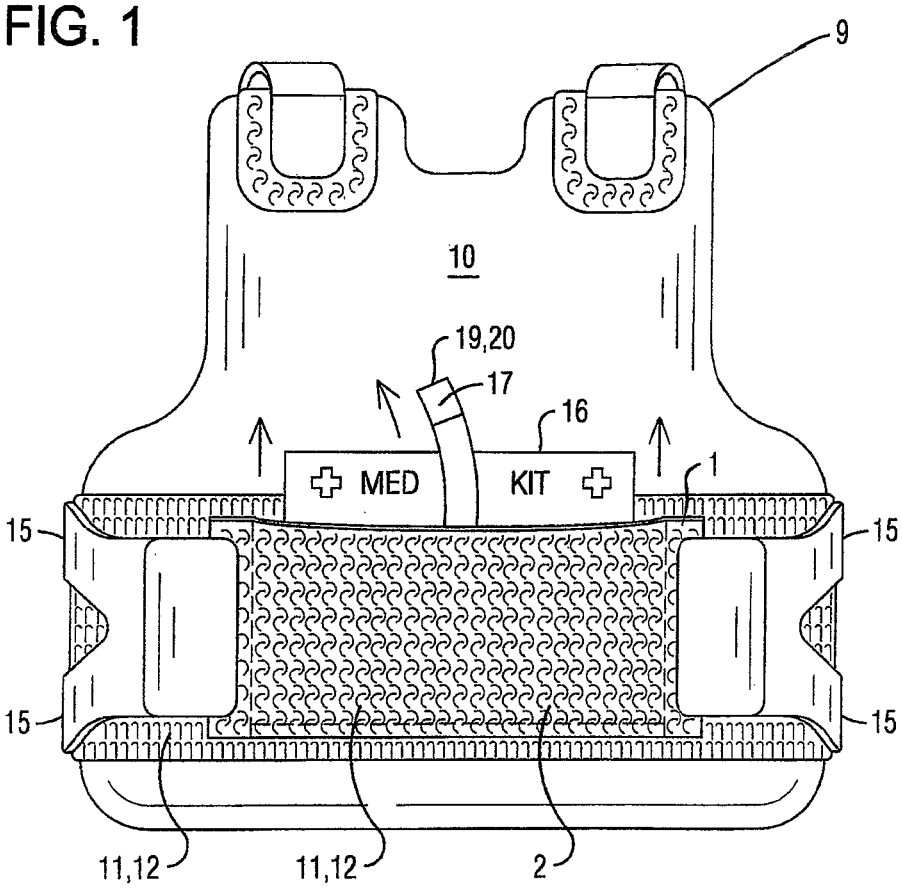
FIG. 1 is a perspective view of a medical carrier kit of the present invention located on a front panel of a body armor vest.

For purposes of describing the preferred embodiment, the terminology used in reference to the numbered components in the drawings is as follows:

1. medical carrier kit, generally
2. front panel
3. rear panel
4. lower edge
5. side edge
6. opening
7. upper edge
8. interior portion
9. body armor vest
10. front panel
11. attachment means
12. hook and loop fastener
13. front surface
14. rear surface
15. side strap

Figure 2:
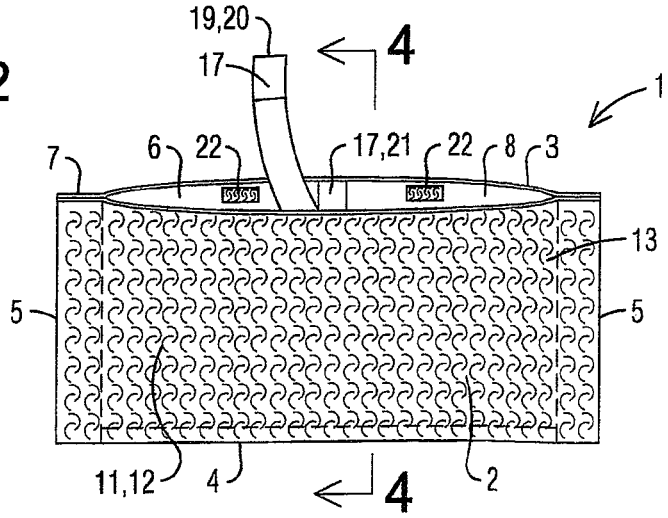
FIG. 2 is a front view of a medical carrier kit of the present invention.
Figure 4:
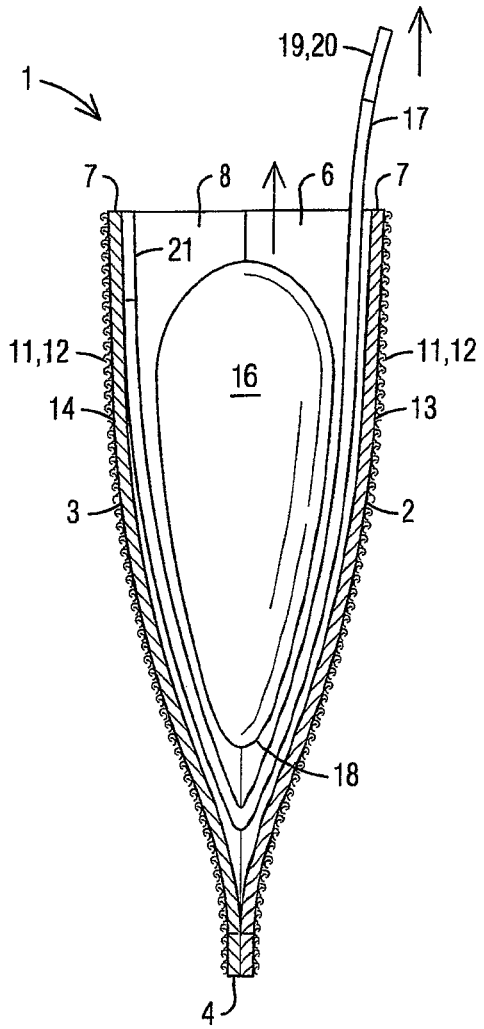
FIG. 4 is a cross sectional view of a medical carrier kit along line 4-4 of FIG. 3.
Figure 3:
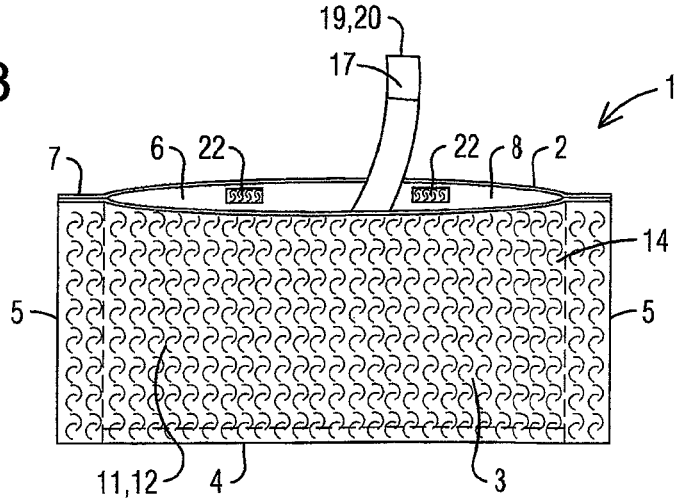
FIG. 3 is a rear view of a medical carrier kit of the present invention.

16. pouch
17. pull strap
18. bottom edge of pouch
19. tab
20. loose end
21. fixed end
22. closure With reference to FIGS. 1-4, the medical kit carrier 1 has a preferably rectangular shape and comprises a front panel 2 secured to a rear panel 3 along a lower edge 4 and side edges 5, thereby creating an opening 6 along the upper edge 7 for accessing an interior portion 8 of the medical kit carrier 1.

The medical carrier kit 1 may be integrated into a body armor vest 9, preferably on a front panel 10 of the body armor vest 9. For example the front panel 2 and rear panel 3 of the medical kit carrier 1 may be permanently attached to the front panel 10 of the body armor vest 9 or just the front panel 2 may be permanently attached to the front panel 10 of the body armor vest 9 with the front panel 2 of the body armor vest 9 acting as the rear panel 3 of the medical kit carrier 1.

Alternatively, the medical kit carrier 1 may be removeably attachable to the body armor vest 9 via an attachment means 11, such as a hook and loop fastener 12. As illustrated here, the medical kit carrier comprises a front surface 13 and a rear surface 14 each of which have a hook and loop fastener 12 as an attachment means 11 located thereon. The hook and loop fastener 12 located on the rear surface 14 of the medical kit carrier 1 engages a hook and loop fastener located on front panel 10 of the body armor vest 9 to which vest securing side straps 15 are normally attached. The medical kit carrier 1 does not interfere with the attachment points on the body armor vest 9 because the straps 15 may be attached to the hook and loop fastener 12 located on the front surface 13 of the medical kit carrier 1. A pouch 16 located in the medical kit carrier 1 used for storing supplies, such as medical supplies, may then be easily removed from the medical kit carrier 1 using a pull strap 17 that is looped around a bottom edge 18 of the pouch 16. When a tab 19 on a loose end 20 of the pull strap 17 is pulled, the pull strap 17 lifts the pouch 16 out of the medical kit carrier 1. A fixed end 21 of the pull strap 17 is secured proximal to the upper edge 7 of the medical kit carrier 1. Closures 22 may also be located on the opening 6 of the medical kit carrier 1 to seal shut the medical kit carrier 1.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A medical kit carrier for body armor vests comprising:
a front panel secured to a rear panel along a lower edge and side edges thereby creating an opening along an upper edge for accessing an interior portion of the medical kit carrier;
said front panel terminating at said upper edge;
said rear panel terminating at said upper edge;
a hook and loop fastener located on a rear surface of the medical kit carrier for attaching the medical kit carrier to a body armor vest;
a hook and loop fastener located on a front surface of the medical kit carrier;
a pull strap having a fixed end secured to the upper edge of the medical kit carrier;
said pull strap having a loose end opposite from the fixed end;
a pouch inserted into the medical kit carrier; and
said loose end of the pull strap looping downward from the fixed end and upper edge of the medical carrier kit around a bottom edge of the pouch and upward toward the upper edge of the medical kit carrier and exiting the opening of the medical kit carrier.

2. The medical kit carrier for body armor vests of claim 1 further comprising:
at least one closure located proximal to the opening of the medical kit carrier.

3. The medical kit carrier for body armor vests of claim 1 further comprising:
a tab located on the loose end of the pull strap.

4. A body armor vest and medical kit carrier comprising:
a body armor vest having a front panel on which a medical kit carrier is attached;
said medical carrier kit comprising a front panel and a rear panel each secured together along a lower edge and side edges thereby creating an opening along an upper edge for accessing an interior portion of the medical kit carrier;
said front panel terminating at said upper edge;
said rear panel terminating at said upper edge;
a hook and loop fastener located on a front surface of the medical kit carrier;
a pull strap having a fixed end secured to the upper edge of the medical kit carrier;
said pull strap having a loose end opposite from the fixed end;
a pouch inserted into the medical kit carrier; and
said loose end of the pull strap looping downward from the fixed end and upper edge of the medical kit carrier around a bottom edge of the pouch and upward toward the upper edge of the medical kit carrier and exiting the opening of the medical carrier kit.

5. The body armor vest and medical kit carrier of claim 4 further comprising:
at least one closure located proximal to the opening of the medical kit carrier.

6. The body armor vest and medical kit carrier of claim 4 further comprising:
at least one side strap having a hook and loop fastener located thereon that engages the hook and loop fastener located on the front surface of the medical kit carrier.

7. A medical kit carrier for body armor vests comprising:
a front panel secured to a rear panel along a lower edge and side edges thereby creating an opening along an upper edge for accessing an interior portion of the medical kit carrier;
said front panel terminating at said upper edge;
said rear panel terminating at said upper edge;
a hook and loop fastener located on a rear surface of the medical kit carrier for attaching the medical kit carrier to a body armor vest;
a hook and loop fastener located on a front surface of the medical kit carrier;
a pull strap having a fixed end secured to the upper edge of the medical kit carrier;
said pull strap having a loose end opposite from the fixed end;
a pouch inserted into the medical kit carrier;
said loose end of the pull strap looping downward from the fixed end and upper edge of the medical carrier kit around a bottom edge of the pouch and upward toward the upper edge of the medical kit carrier and exiting the opening of the medical kit carrier; and at least one closure located on an interior portion of the medical kit carrier proximal to the opening of the medical kit carrier in a location that allows the at least one closure to be unsealed when the pouch is pulled upward.

8. A body armor vest and medical kit carrier comprising:

a body armor vest having a front panel on which a medical kit carrier is attached;

said medical carrier kit comprising a front panel and a rear panel each secured together along a lower edge and side edges thereby creating an opening along an upper edge for accessing an interior portion of the medical kit carrier;

said front panel terminating at said upper edge;

said rear panel terminating at said upper edge;

a hook and loop fastener located on a front surface of the medical kit carrier;

a pull strap having a fixed end secured to the upper edge of the medical kit carrier;

said pull strap having a loose end opposite from the fixed end;

a pouch inserted into the medical kit carrier;

said loose end of the pull strap looping downward from the fixed end and upper edge of the medical kit carrier around a bottom edge of the pouch and upward toward the upper edge of the medical kit carrier and exiting the opening of the medical carrier kit; and at least one closure located on an interior portion of the medical kit carrier proximal to the opening of the medical kit carrier in a location that allows the at least one closure to be unsealed when the pouch is pulled upward.

* * * * *